US005345036A

United States Patent [19]

Kondo

[11] Patent Number: 5,345,036

[45] Date of Patent: Sep. 6, 1994

[54] VOLUME CONTROL APPARATUS FOR AN AUTOMATIC PLAYER PIANO

[75] Inventor: Tetsusai Kondo, Shizuoka, Japan

[73] Assignee: Kabushiki Kaisha Kawai Gakki Seisakusho, Japan

[21] Appl. No.: 958,569

[22] Filed: Oct. 8, 1992

[30] Foreign Application Priority Data

Dec. 25, 1991 [JP] Japan ..... 3-356422

[51] Int. Cl.[5] ..... G10F 1/02; G10G 3/04; G10H 1/46

[52] U.S. Cl. ..... 84/633; 84/21; 84/462

[58] Field of Search ..... 84/609-620, 84/626, 633-638, 21, 22, 462

[56] References Cited

U.S. PATENT DOCUMENTS 5,063,820 11/1991 Yamada ..... 84/609

5,138,926 8/1992 Stier et al. ..... 84/615

*Primary Examiner*—Stanley J. Witkowski

*Attorney, Agent, or Firm*—Andrus, Sceales, Starke & Sawall

[57] ABSTRACT

An apparatus for automatic playing of a piano has storage register for storing play information, which includes key depression force information, and that sequentially reads the play information from the storage register and that uses included key depression force to activate operation terminals. The apparatus comprises: volume designating circuitry for designating volume; a volumn control information generator for generating volume control information in agreement with a volume designated by the volume designating circuitry; a calculator for performing a specified arithmetic operation involving the key depression force information and the volume control information, which is generated by the volume control information generator, to obtain new key depression information; and a controller for driving the operation terminals based on the new key depression force information that is provided by the calculator.

6 Claims, 7 Drawing Sheets

COEFFICIENT TABLE

| VOL-UME | COEFFICIENT K |
|---|---|
| 01 | 0.55 |
| 02 | 0.56 |
| | |
| 08 | 0.83 |
| 09 | 0.91 |
| 10 | 1.00 |
| 11 | 1.10 |
| 12 | 1.20 |
| | |
| 18 | 1.80 |
| 19 | 1.90 |
| 20 | 2.00 |

Fig2A

CONSTANT TABLE

| VOL-UME | CONSTANT C | |
|---|---|---|
| 01 | −16.36 | |
| 02 | −14.28 | ④ |
| | | |
| 08 | −2.40 | |
| 09 | −1.10 | |
| 10 | 0.00 | ⑤ |
| 11 | 0.91 | |
| 12 | 1.66 | |
| | | |
| 18 | 4.44 | |
| 19 | 4.73 | ⑥ |
| 20 | 5.00 | |

Fig2B

VOLUME CONTROL APPARATUS FOR AN AUTOMATIC PLAYER PIANO

BACKGROUND OF THE INVENTION

1. Field of the Invention

The present invention relates to an apparatus for the automatic playing of a piano, specifically, an apparatus that plays music on demand by using prerecorded play information, which is held in a storage device, to control a keyboard and pedals.

Apparatuses for automatic playing that are attached to, for example, acoustic pianos are in current, practical use. To produce music, these apparatuses use prerecorded play information to operate drive mechanisms that manipulate keyboards and pedals.

Such an apparatus also incorporates a means to adjust the volume of the music produced so that it is suitable for the performance location and the social ambiance.

2. Description of the Related Art

A conventional apparatus for automatic playing of a piano incorporates a storage device, e.g., a floppy disk, that holds play information, including, for example, key numbers, key depression force and time information. When the apparatus receives a signal to begin playing, via, for example, an operation panel, it reads play information from the storage device and uses this information in its operation of the keyboard and pedals of a piano.

More specifically, play information constituting event information groups is previously stored in a storage device. As shown by the example in FIG. 6, one event information group consists of an identification symbol, a key number, key depression force, and time information.

When playing is initiated, one event information group of the play information is read from the storage device, and the included time information is examined. When the time information corresponds to an execution timing (time) for the read-out event information, procedures for this event are performed, i.e., keys are depressed or released.

The execution time for an event information group is determined as follows: A time count, which is held by a time counter that counts clock cycles, is compared with the time information in the read-out event information group, and when they correspond it is assumed that the procedures for the event should be performed.

After the procedures for one event information group have been completed, the next event information group is read from the storage device and the described process is repeated. Music is produced by repeatedly reading and processing event information groups.

Dynamic automatic playing is controlled as follows: The average electric power is determined based on information that dictates how strongly, or at what key depression force, keys (key numbers) designated in play information should be depressed, and solenoids are driven using the determined electric power. Keys and pedals coupled to these solenoids are therefore manipulated (depressed or released) at a strength (velocity) relative to the average electric power, and predetermined dynamic music is played.

Volume control methods commonly used for conventional apparatuses for automatic playing of pianos are as follows:

With one method where a volume is designated through operation of a volume control, to increase volume the automatic playing apparatus adds a predetermined value, which agrees with a control value selected via the volume control, to the key depression force included in play information; and to reduce volume the apparatus subtracts a predetermined value, which agrees with a control value selected via the volume control, from the key depression force in the play information. In this manner, a conventional apparatus prepares the key depression force information that is supplied to a solenoid driver.

This method supplies a selected voltage, determined in consonance with control values designated via the volume control, to activate solenoids to operate a keyboard and pedals, and absolutely increases or decreases key depression force.

Using this method, while the absolute volume is raised or reduced, the range of the volume, i.e., the dynamic range, is not changed. This is because, as shown in a graph in FIG. 4, a conversion characteristic, which is represented by broken lines, occupies parallel positions as it is shifted up or down. When the volume is changed in this manner, discordant sounds are produced, especially when the volume is lowered.

In another common volume control method, which is depicted in FIG. 7, data for different conversion characteristics are stored in multiple conversion tables $50_1$ to $50_n$. When a specific volume is designated via a volume control, one of the conversion tables $50_1$ to $50_n$ is selected by a switch 51; and, from the data in the selected conversion table, information about key depression force that is to be sent to the solenoids is obtained.

With this method, by setting the contents of a conversion table to a desired value, it is possible not only to control absolute volume but also to control the dynamic reproduction range of music. As its memory size depends on the number of conversion tables, however, this method requires too large a memory.

The first volume control method described above, the method that, in consonance with the operation of a volume control, effects an absolute volume modification of reproduced music but does not affect the reach of soft and strong sounds, i.e., the dynamic range, is not desirable because tonal quality, especially when a lower volume is designated, is not tempered, and reproduced music, when the dynamic range is too wide for the selected volume, is inharmonious.

The other method described above, whereby, in consonance with the operation of a volume control, volume is controlled by the selection of one of a multiple of conversion tables, is also not desirable because it requires too large a memory.

SUMMARY OF THE INVENTION

To overcome these shortcomings, it is the object of the present invention to provide an apparatus, for automatic playing of a piano, that does not require a large memory, and that reduces both key depression force and dynamic range, especially when a soft sound is designated via a volume control, to eliminate discordancies when soft musical tones are produced.

To achieve the above object, an apparatus for automatic playing of a piano according to the present invention has storage means for storing play information, which includes key depression force information, and that sequentially reads the play information from the storage means and that uses the included key depression force to activate operation terminals. The apparatus comprises: volume designating means for designating volume; generating means for generating volume control information in agreement with a volume designated by the volume designating means; calculation means for performing a specified arithmetic operation involving the key depression force information and the volume control information, which is generated by the generating means, to obtain new key depression information; and control means for driving the operation terminals based on the new key depression force information that is provided by the calculation means.

According to the present invention, volume control information, which includes, e.g., a volume parameter and a dynamic range parameter, is generated in agreement with the volume that is designated. Subsequently, a specified arithmetic operation, which uses the volume control information that has most recently been generated and the key depression force that is included in the play information that has most recently been read from a storage device, is performed and the resultant value is employed to drive operation terminals and to thus control the dynamics of reproduced music.

As the aforementioned calculation provides not only volume control information but also key depression force, the count of the required parameters for the generation of volume control information need only equal the count of the available volume levels, and the size of the memory space required for storage of volume control information is reduced.

Further, as the key depression force information, which is included in the play information, is calculated using parameters for volume control information that correspond to the current volume control setting, the apparatus uses the key depression force information to simultaneously control both volume and dynamic range. Music is therefore played at a desired volume and within a desired dynamic range, and discordancies are eliminated even when soft sounds are designated.

BRIEF DESCRIPTION OF THE DRAWINGS

FIGS. 2A and 2B are diagrams showing an example of a conversion table, used in the embodiment of the present invention, where coefficients and constants are stored;

DETAILED DESCRIPTION OF THE PREFERRED EMBODIMENT

Figure 1:
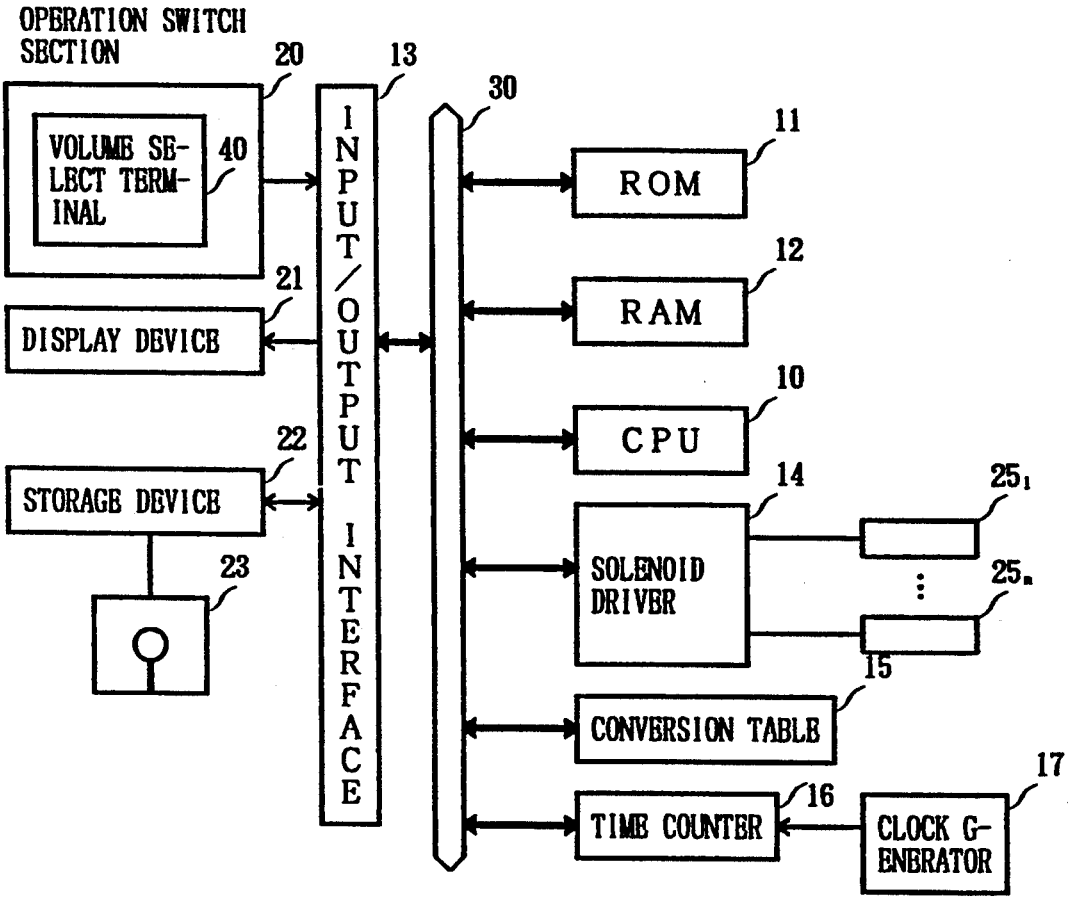
FIG. 1 is a schematic block diagram illustrating the general structure of one embodiment of an apparatus for automatic playing of a piano according to the present invention.

The preferred embodiment of the present invention will now be described in detail while referring to the accompanying drawings. FIG. 1 is a schematic block diagram illustrating the general structure of an apparatus for automatic playing of a piano according to the present invention.

A Central Processing Unit (CPU) 10 controls the individual sections of the automatic playing apparatus in consonance with a control program that is stored in a Read Only Memory (ROM) 11. Besides the control program, various data constants to be used by the CPU 10 are stored in the ROM 11. The ROM 11 is accessed by the CPU 10 via a system bus 30.

In a Random Access Memory (RAM) 12 are defined a work area for the CPU 10 and various registers and flags to control the apparatus for automatic playing of a piano. The PLUM 12, as well as the ROM 11, is accessed by the CPU 10 via the system bus 30.

An input/output interface 13 is connected to the system bus 30, and an operation switch section 20, a display device 21 and a storage device 22 are connected to the input/output interface 13.

The operation switch section 20 includes a volume control 40, which is the primary feature of the present invention, and various other switches (not shown), such as a start switch, for instructing the start for automatic playing, and a tempo switch, for instructing a tempo.

The ON/OFF switch states of the operation switch section 20 are detected by a scan circuit (not shown), and are sent via the input/output interface 13 to the CPU 10. The CPU 10 stores the ON/OFF switch state information in a predetermined area in the RAM 12.

The display device 21 is, for example, an LCD (liquid crystal display), and is used to display messages and the condition of the automatic playing apparatus. Thus, for example, when automatic playing is started, the display device 21 is employed to display the performance duration. The display device 21 is controlled by information that is sent from the CPU 10 via the input/output interface 13.

The storage device 22 is, for example, a floppy disk unit that employs a floppy disk 23 as a recording medium. Play information is recorded on the floppy disk 23.

Figure 6:
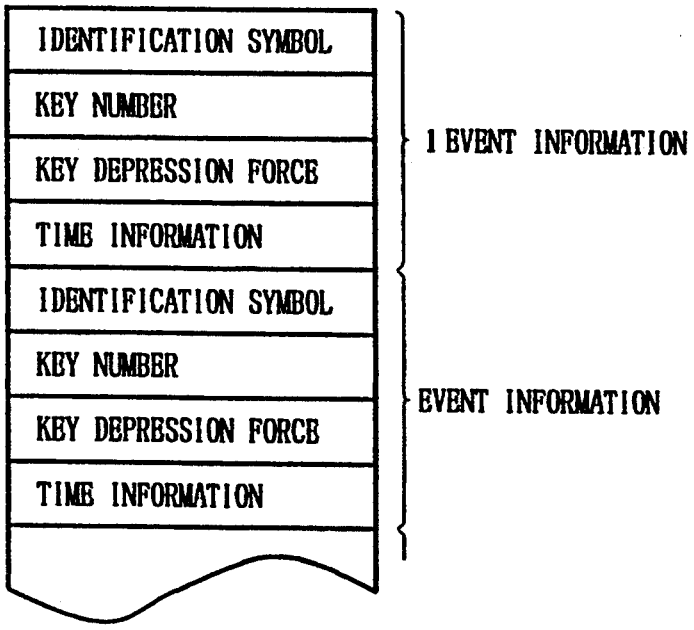
FIG. 6 is a diagram illustrating an example of event information that is used in the embodiment of the present invention.
Figure 7:
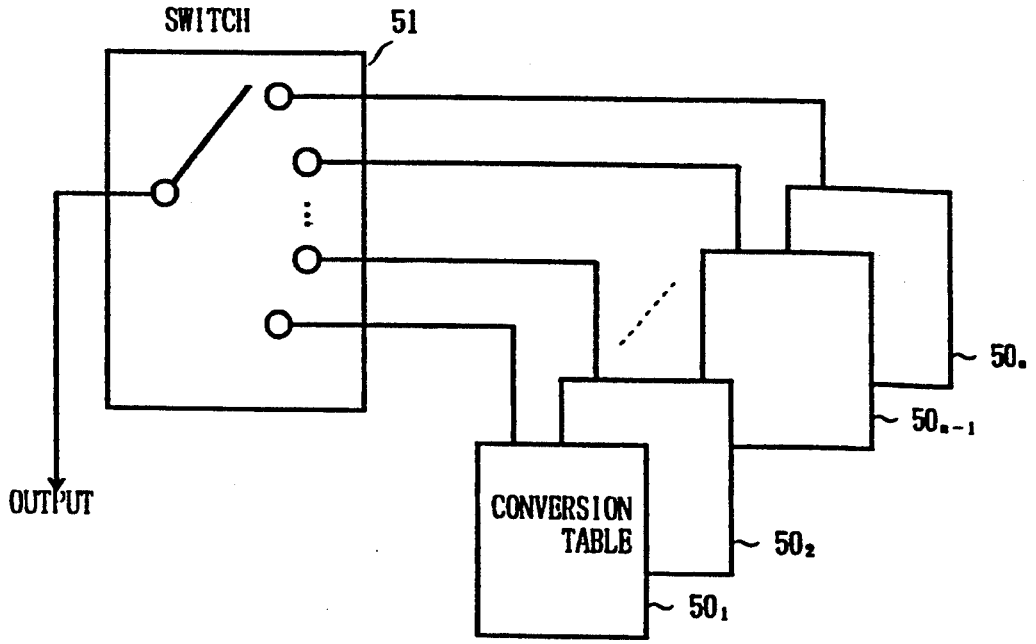
FIG. 7 is a diagram for explaining an example of conventional volume control.

As shown in FIG. 6, event information groups constitute play information. Each event information group consists of an identification symbol, a key number, key depression force, and time information.

The identification symbol identifies the type of event information. The identification symbol is used, for example, to determine whether the event information is play information for a keyboard terminal, or is play information for a pedal terminal, and to indicate whether the event information is data for an ON event or for an OFF event.

A key number shows the number of a key where an event should be performed. Key depression force determines the force or the speed of key depression/release at the time of an ON event or an OFF event. A specified arithmetic operation is performed on the key depression information, as will be described later.

Time information is data that indicates the timing (time) for the processing of event information. When such time information corresponds to a value held by a time counter 16, an event in consonance with the event information that is currently being processed will be performed.

Play information, after it has been read from the floppy disk 23 that is employed by the storage device 22, is sent to the CPU 10 via the input/output interface 13 to be used for automatically playing a musical instrument.

A solenoid driver 14 drives solenoids $25_1$ to $25_n$, one of which is provided for each key. These solenoids $25_1$ to $25_n$ are coupled to correspondingly numbered keys. When the solenoid driver 14 is activated by the CPU 10, the solenoids $25_1$ to $25_n$ are driven accordingly and perform a key depression function by depressing (or affecting) their correspondingly numbered keys.

A key release function is accomplished when the solenoid driver 14 is stopped by the CPU 10 and the solenoids $25_1$ to $25_n$ are inactivated.

A conversion table 15 is means for producing volume control information, a primary feature of the present invention. As shown in FIGS. 2A and 2B, the conversion table 15, which is stored in, for example, a ROM, has two major subdivisions, a coefficient table and a constant table.

The coefficient table is used to store predetermined coefficients K (right column) that correspond to volume levels of the volume control 40 (left column). In this embodiment, the table has 20 volume levels. As will be described later, the coefficient K is used to select a conversion rate (inclination degree of lines in FIG. 4 and 5) when given key depression force information is to be converted.

The constant table is used to store predetermined constants C (right column) that correspond to the volume levels of the volume control 40 (left column). As will be described later, when given key depression force information is to be converted, the constant C is employed to supply a bias value, a variable that is calculated based on a key depression force information equivalency of "v=0 ."

The conversion table 15 in this embodiment is provided in an independent ROM; however, alternatively it can be provided in the ROM 11 where programs are stored.

A time counter 16 in FIG. 1 increments a time count at a predetermined speed using a clock signal from a clock generator 17. The time count of the time counter 16 is read by the CPU 10 and is used to establish a tone-0N timing.

The CPU 10, the ROM 11, the RAM 12, the input-/output interface 13, the solenoid driver 14, the conversion table 15, and the time counter 16 are mutually connected by the system bus 30.

With such an arrangement, the operation of this embodiment will now be described.

When the start switch (not shown) of the operation switch section 20 is depressed, the switch state is sent to the CPU 10 via the input/output interface 13. When the CPU 10 receives the signal that the start switch is ON, it then reads one event information group of play information (see FIG. 6) from the storage device 22, and extracts the time information from that event information group.

Following this, count values are read from the time counter 16 and these values are compared with the extracted time information. When the result of such a comparison is "count value≧time information", the event information is executed.

After the event information has been executed, the next event information group is read from the storage device and the fore described processes are repeated to thereby play music.

The above described operation is followed by a procedure for automatic playing based on prestored play information. The operation is performed in real time in consonance with play information that is supplied by an external device. In this case, time information is not included in event information, and execution timing checks are not required.

When event information is to be executed, volume control is processed as follows: When the volume control 40 on the operation switch section 20 is set, terminal position data that agrees with the setting position of the volume control 40 is sent via the input/output interface 13 to the CPU 10. The CPU 10 stores the terminal position data, which includes the current position of the volume control 40, in a predetermined area of the RAM 12.

When it is time to execute event information, the conversion table 15 is accessed and the coefficient K and the constant C are read as volume control information from volume levels that correspond to the terminal position data. If, for example, the position data is "02", then "0.56", the coefficient K, and "−14.28", the constant C, are read out.

Then, using the relevant volume control information, the key depression force that is included in the most recently read event information group is converted using the following equation:

$$v=K(V+C) \quad (1),$$

where K is a coefficient, V is the key depression force from the current event information, C is a constant, and v is the key depression force after conversion.

Using equation (1), if the coefficient K and the constant C are determined to agree with the volume designated by the volume control 40, the desired conversion for an arbitrarily designated volume is obtained.

Examples of the conversion of key depression force information, and results that are therewith obtained, will now be described in detail while referring to FIG. 4. The horizontal line in the graph in FIG. 4 represents a key depression force V before conversion, and the vertical line represents a key depression force v after conversion.

Figure 4:
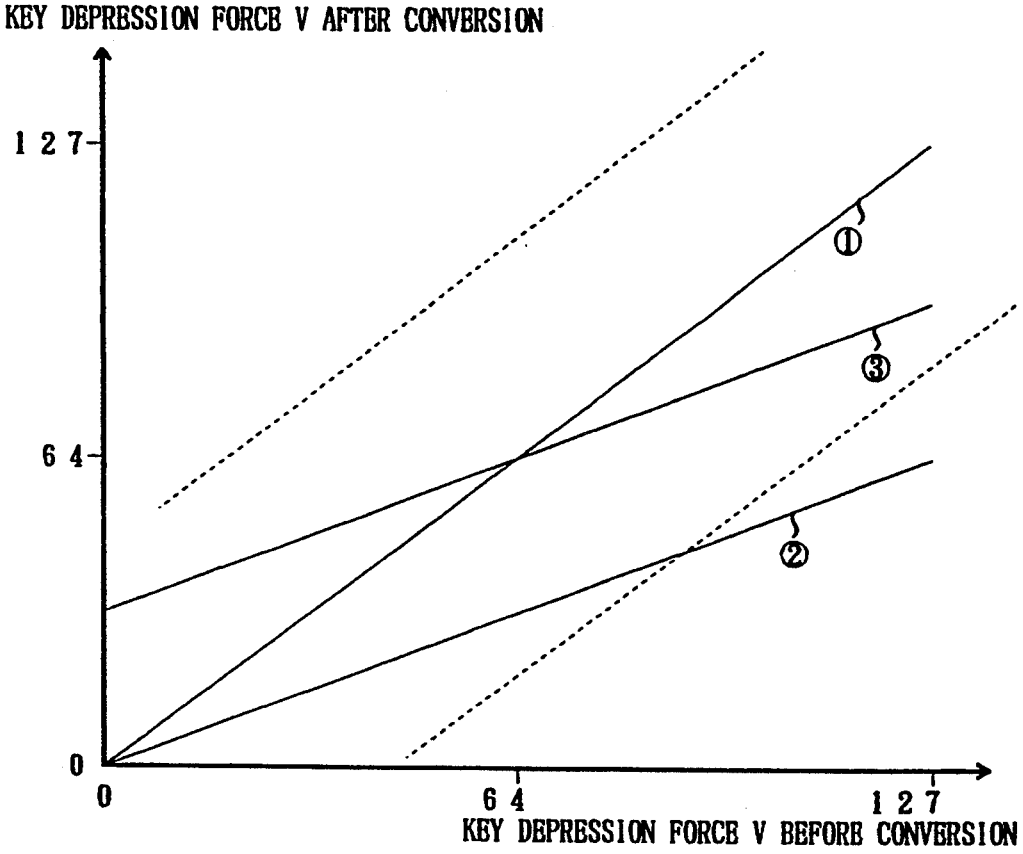
FIG. 4 is a graph for explaining the principle of the conversion characteristic of key depression force of the present invention.

In FIG. 4, example ① depicts a conversion for a conversion rate (rate of the increase of the key depression v to the increase of the key depression force V) of "1", i.e., K=1 and C=0. This, in substance, means that no conversion was performed, and is the same as for normal playing for which no volume designation is made.

Example ② depicts a conversion wherein volume has been reduced and dynamic range has been compressed by converting the key depression force V at a lower conversion rate with K=0.5 and C=0, and example ③ depicts a conversion wherein the region of low volume (soft sounds) has been raised to compress dynamic range.

Figure 5:
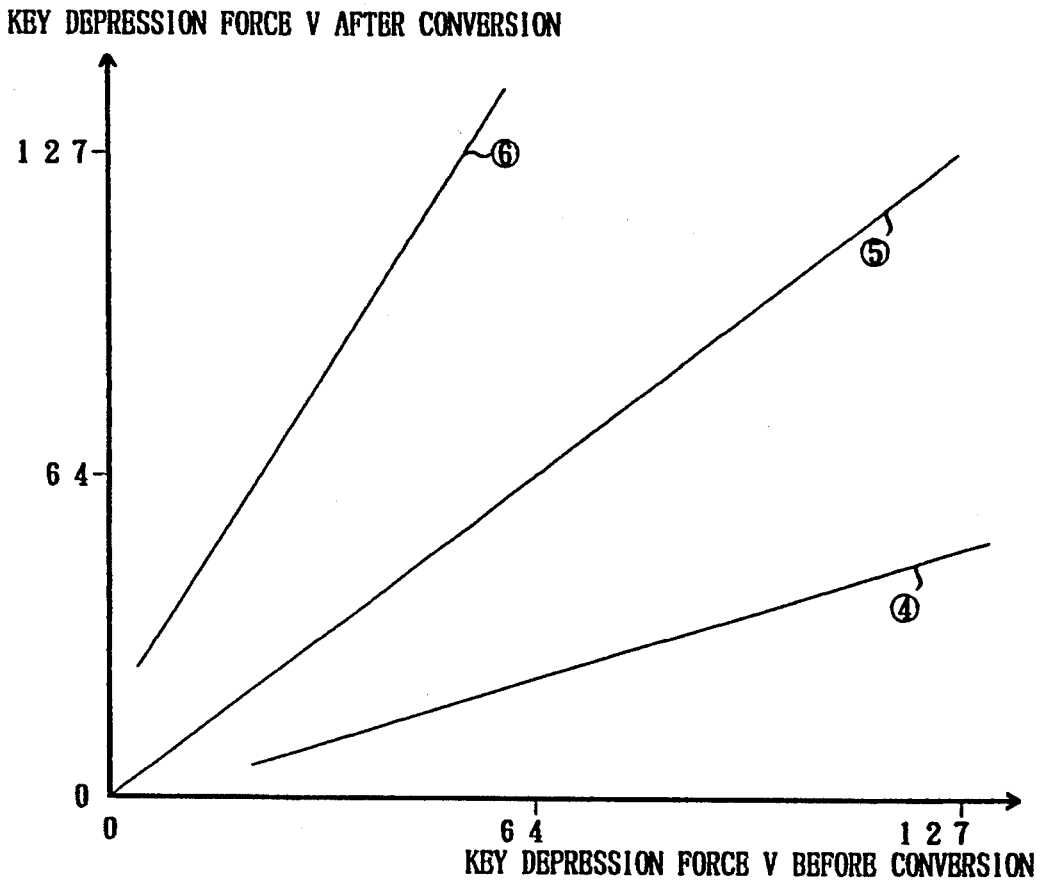
FIG. 5 is a graph for explaining the conversion characteristic of key depression force of the embodiment of the present invention.

FIG. 5 shows key depression force V before conversion along the horizontal line and key depression force v after conversion along the vertical line, for the designated volume levels "2", "10", and "19" in FIG. 2.

Example ④ is for a designated volume "2" (low volume), where dynamic range is compressed and key depression force is totally reduced; example ⑤ is for a designated volume "10" (normal volume), where the ratio of the value of the key depression force V to the value of the key depression force v is "1:1"; and example ⑥ is for a designated volume "19" (high volume), where dynamic range is expanded and key depression force is totally increased.

Key depression force in play information, as defined, has 128 levels, "0" to "127". When a converted, or calculated, key depression force is either smaller than "1" or greater than "127", a specified process is performed on the resultant key depression force to bring it within the range of "1" to "127". A key depression force of "0" is normally used as play information for key release.

As described above, it is easy to obtain desired conversion characteristics by assigning arbitrary values to the coefficient K and the constant C that constitute the volume control information. New key depression force information may then be calculated by merely performing an arithmetic operation based on the terminal position data from the volume control 40.

Figure 3:
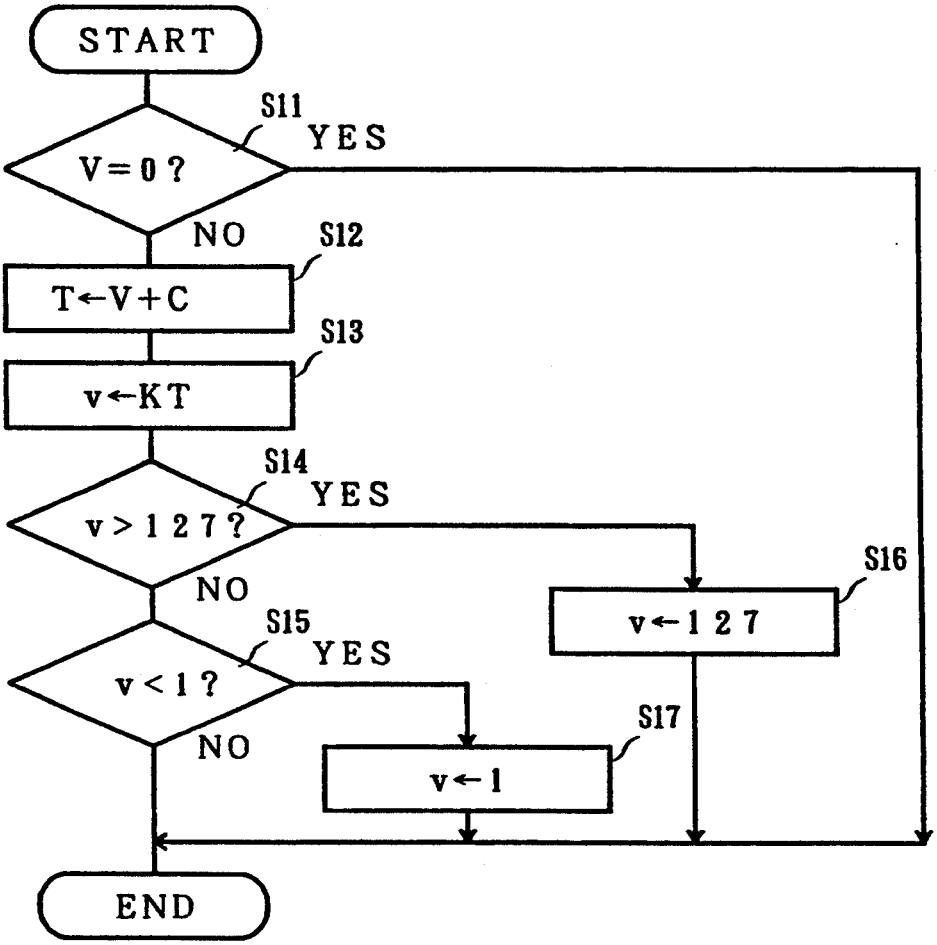
FIG. 3 is a flowchart for explaining the operation of the embodiment of the present invention.

The procedure for obtaining a new key depression force will now be explained referring to a flowchart shown in FIG. 3.

First, a check is performed to determine whether or not key depression force V in the event information is "0" (step S11). If the key depression force V is found to be "0", it is assumed that key release has been instructed, and this process is terminated without performing the succeeding steps. That is, the solenoid driver 14 is inactivated and keys that are designated by key numbers in the event information are released.

If the key depression force V is not "0", a constant C, which is read from a constant table, is added to the key depression force V to obtain an intermediate value T (step S12). Then, the intermediate value T is multiplied by a coefficient K, which is read from a coefficient table, to obtain a new key depression force v (step S13).

A check is performed to determine whether or not the new key depression force v in step S13 is greater than "127" (step S14). If the key depression force v is found to be greater than "127", it is set to "127" (step S16). The process is thereafter terminated.

If the key depression force v in step S13 is found to be "127" or smaller, a check is performed to determine whether or not the key depression force v is smaller than "1" (step S15). When the key depression force v is found to be smaller than "1", it is set to "1" (step S17). The process is thereafter terminated.

If in step S15, however, the new key depression force v obtained in step S13 is found to be "1" or greater, i.e., "$1 \leqq v \leqq 127$", no value adjustment is necessary and the process is immediately terminated.

Through the above process, conversion of a key depression force characteristic is performed by assessing the conversion table 15 and reading and using its contents in agreement with a designated volume selected via the volume control 40.

As described above in detail, although the apparatus for automatic playing of a piano according to the present invention does not require a large memory, it can simultaneously control both volume and dynamic range, and can alter key depression force through a simple operation. Especially when low volume is designated, the apparatus can compress dynamic range as well as reducing key depression force, and can thus eliminate inharmonious musical sounds when soft tones are produced.

What is claimed is:

1. In an apparatus for automatically playing a piano, said apparatus having storage means for storing play information, which includes key depression force information, said apparatus sequentially reading said play information from said storage means and and activating operation terminals, the improvement comprising circuitry for altering the volume at which the piano is played and for expanding or decreasing the dynamic range through which the volume may altered, said circuitry comprising:

volume designating means (40) for designating a volume at which the piano is to be played;

generating means (15) for generating volume control information in agreement with a volume designated by said volume designating means, said generating means comprising a single conversion table having a constant table and a coefficient table that contain a first factor (C) and a second factor (K), respectively, for each level of volume control information, said constant table providing said first factor (C) by which the key depression force information (V) is to be altered for establishing the volume at which the piano is to be played, said coefficient table providing said second factor (K) by which the key depression force information (V) is to be altered for establishing the dynamic volume range at which the piano is to be played;

calculation means for performing a mathematical operation employing said key depression force information (V) and said first and second factors (K,C) generated by said generating means, to obtain new key depression force information (v); and control means (14) for activating said operation terminals based on said new key depression force information provided by said calculating means.

2. Circuitry according to claim 1, wherein said circuitry is further defined as one for use in apparatus in which said play information includes event information groups, and each of said event information groups comprises an identification symbol, a key number, said key depression force information, and time information.

3. Circuitry according to claim 2, wherein said identification symbol of each event information group identifies types of event information, and is used to determine whether said event information is play information for a keyboard terminal, or is play information for a pedal terminal, and is used to indicate whether said event information is data for an ON event or for an OFF event.

4. Circuitry according to claim 2, wherein said key number shows a number of a key of the piano where an event should be performed, and said key depression force information is used to obtain a force or a speed of key depression/release at the time of an ON event or an OFF event.

5. Circuitry according to claim 2, wherein said apparatus has a clock generator and a time counter and wherein said time information is data that indicates a timing for processing said event information groups, using said clock generator and said time counter.

6. Circuitry according to claim 1 wherein said calculation means performs the mathematical operation $$v=K(V+C).$$

* * * * *